US006221093B1

(12) United States Patent
Prince

(10) Patent No.: US 6,221,093 B1
(45) Date of Patent: Apr. 24, 2001

(54) INFANT PACIFIER AND PILLOW

(76) Inventor: Cynthia L. Prince, 1715 N. Shamrock Ave., Upland, CA (US) 91784

( * ) Notice: Subject to any disclaimer, the term of this patent is extended or adjusted under 35 U.S.C. 154(b) by 0 days.

(21) Appl. No.: 09/428,887

(22) Filed: Oct. 28, 1999

(51) Int. Cl.[7] ..... A61J 17/00
(52) U.S. Cl. ..... 606/234; 606/235; D24/193
(58) Field of Search ..... 606/234, 235, 606/236; D24/193–196

(56) References Cited

U.S. PATENT DOCUMENTS

| | | | | |
|---|---|---|---|---|
| D. 318,122 | * | 7/1991 | Roberts | D24/194 |
| D. 331,287 | * | 11/1992 | Smith | D24/193 |
| D. 337,385 | * | 7/1993 | Lussier | D24/194 |
| D. 380,268 | * | 6/1997 | Krause et al. | D24/193 |
| D. 415,837 | * | 10/1999 | Williams | D24/193 |
| 4,277,910 | * | 7/1981 | Kramer | 606/234 |
| 4,697,589 | * | 10/1987 | King et al. | 606/234 |
| 4,765,037 | * | 8/1988 | Perry | 606/234 |
| 4,990,157 | * | 2/1991 | Roberts et al. | 606/234 |
| 5,344,355 | * | 9/1994 | Silverstein | 606/234 |
| 5,534,014 | * | 7/1996 | Demeritt et al. | 606/234 |
| 5,665,113 | * | 9/1997 | Decker et al. | 606/234 |
| 5,908,439 | * | 6/1999 | Ford et al. | 606/234 |

FOREIGN PATENT DOCUMENTS

| | | | | |
|---|---|---|---|---|
| 523794 | * | 8/1921 | (FR) | 606/234 |

* cited by examiner

*Primary Examiner*—Henry J. Recla
*Assistant Examiner*—Lien Ngo

(57) ABSTRACT

An infant pacifier and pillow for removably attaching a pacifier to a pillow. The infant pacifier and pillow includes a cushion for removably attaching a pacifier to. The cushion comprises a pillow and a covering. The pillow is compressible and the covering encases the pillow. A pacifier for pacifying an infant comprises a nipple and a base. The base has a first side and a second side. At least one clip for receiving a strap is affixed to and extends away from the second side of the base of the pacifier. A bore for receiving a nipple is in the base. The nipple is elongate having a distal portion and a proximal portion. The distal portion of the nipple is fixedly coupled in the bore of the base. A strap for securing the pacifier to the cushion is secured by the clip to the base. The strap has two ends. Each of the ends has a fastener means thereon such that the first and second ends of the strap are fastenable together.

1 Claim, 1 Drawing Sheet

INFANT PACIFIER AND PILLOW

BACKGROUND OF THE INVENTION

1. Field of the Invention

The present invention relates to infant pacifiers and more particularly pertains to a new infant pacifier and pillow for removably attaching a pacifier to a pillow.

2. Description of the Prior Art

The use of infant pacifiers is known in the prior art. More specifically, infant pacifiers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,534,014; U.S. Pat. No. 5,665,113; U.S. Pat. Des. No. 380,268; U.S. Pat. No. 4,697,589; U.S. Pat. No. 5,344,355; and U.S. Pat. No. 2,475,923.

While these devices fulfill their respective, particular objectives and requirements, the aforementioned patents do not disclose a new infant pacifier and pillow. The inventive device includes a cushion for removably attaching a pacifier to. The cushion comprises a pillow and a covering. The pillow is compressible and the covering encases the pillow. A pacifier for pacifying an infant comprises a nipple and a base. The base has a first side and a second side. At least one clip for receiving a strap is affixed to and extends away from the second side of the base of the pacifier. A bore for receiving a nipple is in the base. The nipple is elongate having a distal portion and a proximal portion. The distal portion of the nipple is fixedly coupled in the bore of the base. A strap for securing the pacifier to the cushion is secured by the clip to the base. The strap has two ends. Each of the ends has a fastener means thereon such that the first and second ends of the strap are fastenable together.

In these respects, the infant pacifier and pillow according to the present invention substantially departs from the conventional concepts and designs of the prior art, and in so doing provides an apparatus primarily developed for the purpose of removably attaching a pacifier to a pillow.

SUMMARY OF THE INVENTION

In view of the foregoing disadvantages inherent in the known types of infant pacifiers now present in the prior art, the present invention provides a new infant pacifier and pillow construction wherein the same can be utilized for removably attaching a pacifier to a pillow.

The general purpose of the present invention, which will be described subsequently in greater detail, is to provide a new infant pacifier and pillow apparatus and method which has many of the advantages of the infant pacifiers mentioned heretofore and many novel features that result in a new infant pacifier and pillow which is not anticipated, rendered obvious, suggested, or even implied by any of the prior art infant pacifiers, either alone or in any combination thereof.

To attain this, the present invention generally comprises a cushion for removably attaching a pacifier to. The cushion comprises a pillow and a covering. The pillow is compressible and the covering encases the pillow. A pacifier for pacifying an infant comprises a nipple and a base. The base has a first side and a second side. At least one clip for receiving a strap is affixed to and extends away from the second side of the base of the pacifier. A bore for receiving a nipple is in the base. The nipple is elongate having a distal portion and a proximal portion. The distal portion of the nipple is fixedly coupled in the bore of the base. A strap for securing the pacifier to the cushion is secured by the clip to the base. The strap has two ends. Each of the ends has a fastener means thereon such that the first and second ends of the strap are fastenable together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant pacifier and pillow apparatus and method which has many of the advantages of the infant pacifiers mentioned heretofore and many novel features that result in a new infant pacifier and pillow which is not anticipated, rendered obvious, suggested, or even implied by any of the prior art infant pacifiers, either alone or in any combination thereof.

It is another object of the present invention to provide a new infant pacifier and pillow which may be easily and efficiently manufactured and marketed.

It is a further object of the present invention to provide a new infant pacifier and pillow which is of a durable and reliable construction.

An even further object of the present invention is to provide a new infant pacifier and pillow which is susceptible of a low cost of manufacture with regard to both materials and labor, and which accordingly is then susceptible of low prices of sale to the consuming public, thereby making such infant pacifier and pillow economically available to the buying public.

Still yet another object of the present invention is to provide a new infant pacifier and pillow which provides in the apparatuses and methods of the prior art some of the advantages thereof, while simultaneously overcoming some of the disadvantages normally associated therewith.

Still another object of the present invention is to provide a new infant pacifier and pillow for removably attaching a pacifier to a pillow.

Yet another object of the present invention is to provide a new infant pacifier and pillow which includes a cushion for removably attaching a pacifier to. The cushion comprises a pillow and a covering. The pillow is compressible and the covering encases the pillow. A pacifier for pacifying an infant comprises a nipple and a base. The base has a first side and a second side. At least one clip for receiving a strap is affixed to and extends away from the second side of the base of the pacifier. A bore for receiving a nipple is in the base. The nipple is elongate having a distal portion and a proximal portion. The distal portion of the nipple is fixedly coupled in the bore of the base. A strap for securing the pacifier to the cushion is secured by the clip to the base. The strap has two ends. Each of the ends has a fastener means thereon such that the first and second ends of the strap are fastenable together.

Still yet another object of the present invention is to provide a new infant pacifier and pillow that has a pacifier that is completely removable from the pillow so that the pillow is a toy by itself. Further the strap can be removed from the pacifier such that the pacifier is replaceable with other pacifiers.

Even still another object of the present invention is to provide a new infant pacifier and pillow that has a fixed covering having indicia thereon to further enhance the enjoyment of the pacifier and pillow for the infant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
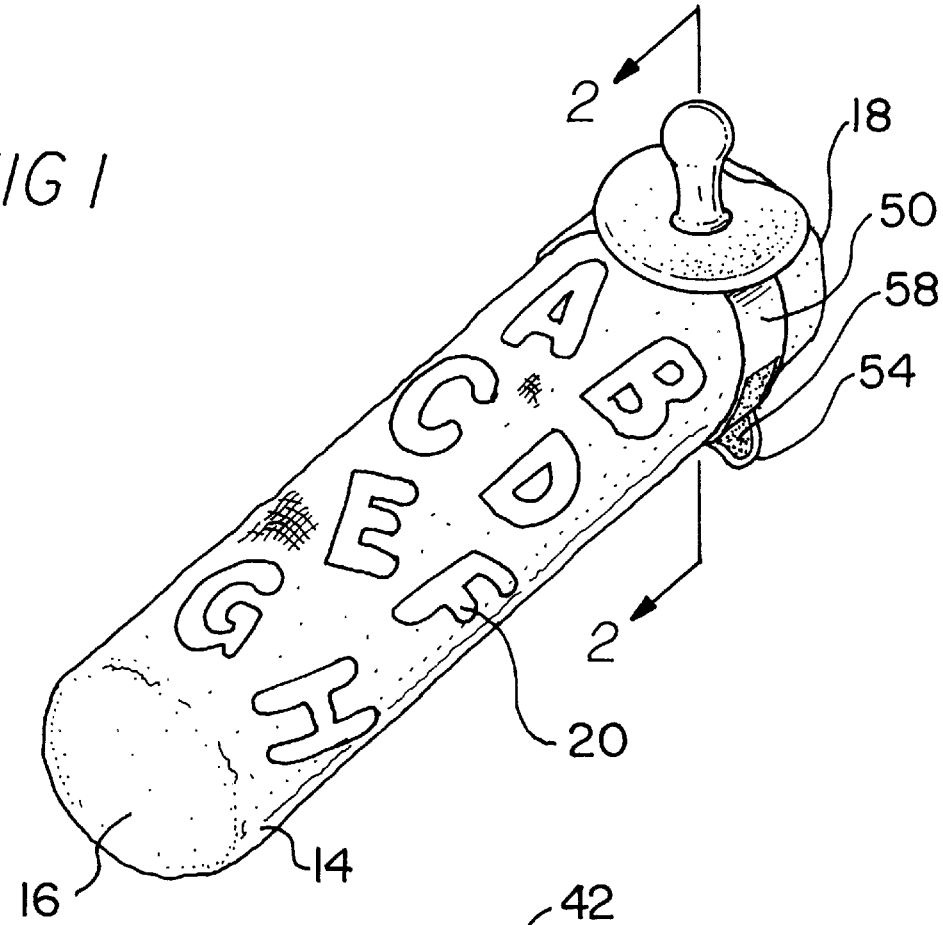
FIG. 1 is a schematic perspective view of a new infant pacifier and pillow according to the present invention.
Figure 2:
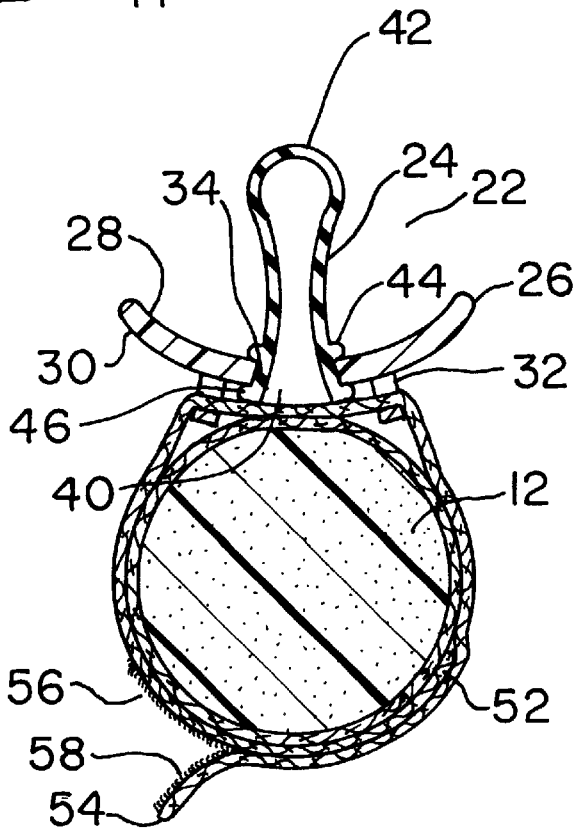
FIG. 2 is a schematic cross-sectional view taken along line 2—2 of the present invention.

With reference now to the drawings, and in particular to FIGS. 1 and 2 thereof, a new infant pacifier and pillow embodying the principles and concepts of the present invention and generally designated by the reference numeral 10 will be described.

As best illustrated in FIGS. 1 and 2, the infant pacifier and pillow 10 generally comprises a cushion for removably attaching a pacifier to. The cushion comprises a pillow 12 and a covering 14. Preferably, the pillow 12 is compressible and is generally cylindrical in shape. The preferred embodiment of the pillow has first 16 and second opposing ends 18, wherein the first and second opposing ends of the pillow are oriented generally parallel to each other. Ideally, the pillow is comprised of material selected from the group comprising foamed rubber material and cotton. The covering 14 encases the pillow. Preferably, the covering is made from material selected from the group consisting of cotton, rayon, silk or nylon.

In the preferred embodiment, a plurality of indicia 20 is located on an outer surface of the covering. The preferred embodiment depicts letters of the alphabet.

A pacifier 22 for pacifying an infant comprises a base 26 and a nipple 24. The base 26 has a first side 28 and a second side 30. The first side 28 and the second side 30 of the base are generally oval shaped. Preferably, the first side of the base is generally concave, and the second side of the base is generally convex.

A pair of clips 32 for receiving a strap are affixed to and extend away from the second side of the base of the pacifier.

A bore 34 for receiving a nipple is preferably in a central portion of the base 26.

The nipple 24 is elongate having a distal portion 40 and proximal portion 42. A first annular ridge 44 and a second annular ridge 46 are formed on the distal portion. The first annular ridge 44 is located between the second annular ridge and the proximal 42 portion of the nipple. The first and second annular ridges are adapted to secure the distal portion of the nipple in the bore 34 of the base such that the second annular ridge 46 is adjacent to the second side 30 of the base and the first annular ridge 44 is adjacent to the first side 28 of the base. The proximal portion 42 of the nipple extends away from the first annular ridge 44. The proximal portion is generally bulbous shaped.

A strap 50 for securing the pacifier to the cushion is elongate and generally rectangular. The strap has a first end 52 and a second end 54. The strap has a top surface 56 and a bottom surface 58. A portion of the strap between the first and second ends of the strap is positioned between and secured by the pair of clips 32. Preferably, the bottom surface 58 of the second end 54 of the strap has a hook and loop fastener means thereon, and the top surface 56 of the first end 52 of the strap has a hook and loop fastener means thereon.

In use, the pacifier 22 is strapped to the pillow 12 by way of the hook and loop fastening means. The pillow allows comfort for the infant who may grasp the pillow while sucking on the pacifier 22. The indicia 20 on the pillow are preferably colorful and will aid in entertaining and pacifying the infant.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An infant pacifier and cushion device comprising:

a cushion comprising a pillow and a covering, said pillow being compressible, said pillow being generally cylindrical in shape, said pillow having first and second opposing ends, wherein said first and second opposing ends of said pillow are oriented generally parallel to each other, said pillow comprising a material selected from the group comprising a foamed material and cotton, said covering encasing said pillow, said covering being made from a material selected from the group consisting of colton, rayon, silk or nylon;

a pacifier for pacifying an infant, said pacifier comprises;

base, said base having a first side and a second side, said first side and said second side of said base being generally oval shaped, said first side of said base being generally concave, said second side of said base being generally convex;

a pair of clips, each of said clips being affixed to and extending away from said second side of said base of said pacifier such that said clips are spaced apart;

a bore formed in a central portion of said base;

an elongate nipple having a distal portion and proximal portion, a first annular ridge and a second annular ridge formed on said distal portion, said first annular ridge being located between said second annular ridge and said proximal portion of said nipple, said first and second annular ridges being adapted to secure said distal portion of said nipple in said bore of said base such that said second annular ridge is adjacent to said second side of said base and said first annular ridge is adjacent to said first side of said base, said proximal portion of said nipple extending away from said first annular ridges, said proximal portion being generally bulbous shaped;

a strap for removably securing said pacifier to said cushion, said strap being elongate, said strap being generally rectangular, said strap having a first end and a second end, said strap having a top surface and a bottom surface, wherein a portion of said strap between said first and second ends of said strap is positioned between and secured to each of said pair of clips, said bottom surface of said second end of said strap halving a hook and loop fastener means thereon, said top surface of said first end of said strap having a hook and loop fastener means thereon such that an effective length of said strap is conformable to a perimeter distance about said covering of said cushion for resisting slippage of said pacifier along a length of said cushions;

a medial portion of said strap extending through said clips such that said clips are positioned between said second side of said base and said cushion for protecting an infant tromn injury due to contact with said clips.

* * * * *